US005996591A

United States Patent [19]

Landa et al.

[11] Patent Number: 5,996,591

[45] **Date of Patent: *Dec. 7, 1999**

[54] METHOD FOR PAINTING NAILS WITH ACRYLIC AIR BRUSH PAINT

[76] Inventors: Cynthia S. Landa; Whitney A. Landa, both of 4401 99th St., Des Moines, Iowa 50322

[ * ] Notice: This patent issued on a continued prosecution application filed under 37 CFR 1.53(d), and is subject to the twenty year patent term provisions of 35 U.S.C. 154(a)(2).

[21] Appl. No.: 08/948,432

[22] Filed: Oct. 10, 1997

[51] Int. Cl.[6] ..... A45D 24/00

[52] U.S. Cl. ..... 132/200; 132/74.5

[58] Field of Search ..... 132/74.5, 73.5, 132/73, 317, 318, 200; 401/198, 199, 262, 202, 207, 196

[56] References Cited

U.S. PATENT DOCUMENTS

| | | | |
|---|---|---|---|
| D. 291,373 | 8/1987 | Korper . | |
| D. 291,374 | 8/1987 | Korper . | |
| 1,819,004 | 8/1931 | Roessinger . | |
| 1,848,751 | 3/1932 | Schnefel . | |
| 2,541,549 | 2/1951 | Bernard . | |
| 2,611,915 | 9/1952 | Prokop et al. . | |
| 2,623,231 | 12/1952 | Gutenstein . | |
| 3,341,884 | 9/1967 | Pryor | 132/74.5 |
| 3,515,154 | 6/1970 | Morgese | 132/73.5 |
| 3,688,450 | 9/1972 | Brockman | 401/199 |
| 3,885,578 | 5/1975 | Hicks | 132/73 |
| 4,640,637 | 2/1987 | Winthrop . | |
| 4,666,709 | 5/1987 | Jankewitz | 424/61 |
| 4,747,419 | 5/1988 | Flynn et al. | 132/73 |
| 4,902,152 | 2/1990 | Seidler . | |
| 5,342,136 | 8/1994 | Fukami | 401/199 |
| 5,427,121 | 6/1995 | Polito . | |
| 5,562,766 | 10/1996 | Gumbert | 106/51 |

FOREIGN PATENT DOCUMENTS

| | | | |
|---|---|---|---|
| 1418087 | 10/1965 | France | 401/199 |
| 2445705 | 10/1980 | France | 401/199 |
| 162751 | 9/1966 | Germany | 401/199 |

OTHER PUBLICATIONS

BADGER Air–Opaque Ready–To–Use Air Brush Colors label, date before Oct. 1997, Badger Air Brush Co., Franklin Park, IL.

Blitzer® Cake Decorator Pens package, date efore Oct. 1997, P&M Promotions Ltd, Merstham, Surrey, England.

CREATEX™ Airbrush Colors User Guide found in The Art Store brochure, date efore Oct. 1997, Des Moines, Iowa.

*Primary Examiner*—Gene Mancene
*Assistant Examiner*—Eduardo C. Robert
*Attorney, Agent, or Firm*—Zarley, McKee, Thomte, Voorhees & Sease

[57] ABSTRACT

A nail painting marker is provided which includes a marker case housing a paint tube. The tube contains air brush marker paint which is applied using an applicator extending from the tube. The applicator has a tip for precise application of the paint to the nail. The tip is sealed with a removable cap when not in use. In the method of use, the nail is contacted directly with the tip of the marker so as to apply paint to the nail, without the need to reload the tip with paint, as with a brush. Multiple markers with different color paints can be used to apply multiple colors to each nail.

10 Claims, 1 Drawing Sheet

METHOD FOR PAINTING NAILS WITH ACRYLIC AIR BRUSH PAINT

FIELD OF THE INVENTION

The present invention relates to a novel process for painting finger and toenails using air brush paint.

BACKGROUND OF THE INVENTION

It has been a common practice for many years for individuals to color their nails. Today, this is primarily done through the application of nail enamels to the surface of the nail using an applicator brush. This method has several disadvantages, however. First, it is difficult to control the amount of enamel in the brush, plus the brush is difficult for many people to control, due to the softness and flexibility of the brush bristles. It is therefore difficult to accurately place the enamel on the nail, avoid getting enamel on the surrounding skin, and produce a coating that is free from brush marks, streaks, or blobs on the nail. This is especially true for individuals attempting to paint their toenails. This lack of precision generally makes this method of application time consuming, which is compounded if more than one coat of enamel is placed on the nails. Further, nail enamel normally takes a long time to dry, especially if it is accidentally "blobbed" on the nail which creates a thicker layer that takes much longer to dry.

The lack of precision of nail enamel brushes also makes it difficult for individuals to create designs or stencil their nails, a trend which has become very popular in the last few years.

Due to the above-mentioned difficulties, many people have resorted to having their nails professionally painted. Many individuals, however cannot afford the expense of professional manicures which can range from $10–$30 per visit. Further, these manicures must be performed as frequently as once per week to fix chips and the gradual wearing off of the enamel.

In recent years, salons have begun using acrylic paints to color nails which allow the manicurist to create designs which could not be previously achieved using brush applicators. Spray-on acrylic paints in an aerosol can permit the fading in and out of colors, an effect which had only been achieved using air brushes. One disadvantage with aerosol acrylic paints, however, is that they are often too difficult for persons other than professional manicurists to apply and create the desired artistic effect.

Another nail coloring method uses an air brush and compressor to apply the paint to the surface of the nails. Air brush painting is widely used in various applications from T-shirts, to touching up photographs, to the creation of original works or art and, as previously mentioned, in nail painting. The air brush is a type of miniature spray gun which atomizes the liquid desired to be painted into droplets, and allows the spray application of the atomized droplets onto a substrate. Air brushes can be used to apply most liquid media, including watercolors, acrylic paints, oil paints, and inks. Alternatively, stencils may be used to limit the sprayed paint to a desired area and/or design.

Air brushes have several advantages over conventional brushes. Air brushes are much faster and more precise than brushes and do not have to be repeatedly reloaded with paint. However, air brushes do not allow for detailed work since the paint which is deposited as a spray is in droplets. Thus, the edges of the sprayed area are "fuzzy" due to the spray pattern. In addition, special care must be taken when using an air brush to prevent the paint from being deposited inadvertently on areas not intended to be painted. Hence, to obtain fine details in air brush painting, it is often necessary for the user to "finish" the design using artist brushes, pens, and pencils.

The air brush nail painting method is costly and also difficult for untrained individuals to use on their nails since not only do individuals need to be trained on how to create certain artistic effects, but they must also learn how to use an air brush. In addition, the initial costs of this procedure does not make it feasible for individual use at home since it involves the purchase of all of the necessary air brushing equipment, as well as different colors of air brush paint. Furthermore, due to the necessity of thoroughly cleaning the air brush in between paint colors, the air brush method is also very inefficient and time consuming.

In an attempt to more precisely apply color to their nails, individuals have been known to draw on their nails with pens or felt tip markers. While this method allows for better precision of application of color to the nail, it also has many drawbacks. First, the ink in ballpoint pens or felt tip markers does not adhere well to fingernails and the ink therefore either does not apply to the nail at all or else it smears and rubs off. The inks are also toxic in some cases.

There is therefore a need in the art for an inexpensive method of painting finger and toe nails wherein the color is easily applied, is nontoxic, dries quickly, adheres well to the nail, and is precise so as to allow individuals to create unique patterns and designs on their nails which cannot be achieved using a brush applicator.

It is therefore an object of the present invention to provide a method and apparatus for painting nails which allows for easy application, thus allowing it to be used not only by professional manicurists, but by individuals at home.

It is a further object of the present invention to provide a method and apparatus for painting nails which provides for accurate and precise application of one or more colors to each nail.

It is still a further object of the present invention to provide a method and apparatus for painting nails which includes a paint that bonds to the nail and which dries relatively quickly.

It is yet a further object of the present invention to provide a method and apparatus for painting nails which is quick, easy, inexpensive, and requires little, if any, training.

These and other objects of the present invention will become clear from the following detailed description of the invention.

SUMMARY OF THE INVENTION

The present invention relates to a novel method and apparatus for painting finger and toe nails. The invention involves the application of an air brush paint directly to the nails using a marker. The marker includes a protective outer casing having a tube within which stores the air brush paint. An absorbent applicator extends from the tube which preferably has a pointed tip for more precise application of the paint directly from the marker onto the nail. The absorbent applicator also provides for the gradual dispensing of the paint from the tube. A removable cap seals the tip of the applicator to protect the marker when it is not in use.

The air brush paint marker provides several advantages over conventional methods of coloring nails. First, the marker is easier for individuals to use than a brush, air brush, or sprayer. The tip enables the individual to make precise, elaborate designs directly on the nail. Since the air brush paint can be applied in very thin layers, it generally dries more quickly than brush-on nail enamels. Further, the air brush paint is nontoxic and bonds well to the nail.

DETAILED DESCRIPTION OF THE PREFERRED EMBODIMENT

The instant invention combines the adherability and consistency of air brush paint with the preciseness and convenience of a marker. More particularly, the nail painting apparatus of the present invention is a marker-type applicator which applies air brush paint by direct contact with the nails. Air brush paint requires a sufficient viscosity to allow the paint to properly flow to the air brush and be atomized. The same type of air brush paint can generally be used in the presently described nail painting marker. The paint must be sufficiently viscous to flow from the marker tip when pressure is applied, and also meet the nontoxic requisite for use on human nails, which is met by most air brush paints and is normally indicated on the packaging.

"Air brush paint" is herein defined as paint that is specifically sold and labeled as "air brush paint" as well as other paints that are modified to the same viscosity range as conventional air brush paints. Specific air brush paint can be purchased from nearly all types of art and paint stores and is usually labeled as such. Generally, specific air brush paint is sold as a nontoxic, water based, permanent acrylic paint having a solids content from about 10–40% by weight. CREATEX™ and BADGER™ brands of air brush paint are the preferred paints. Other thicker paints may also be utilized by diluting them with water or an organic solvent, such as paint thinner, to the solids content range described above or until it has the consistency of milk or paint thinner. Paints in the 10–20% by weight solids content range are generally preferred.

Figure 1:
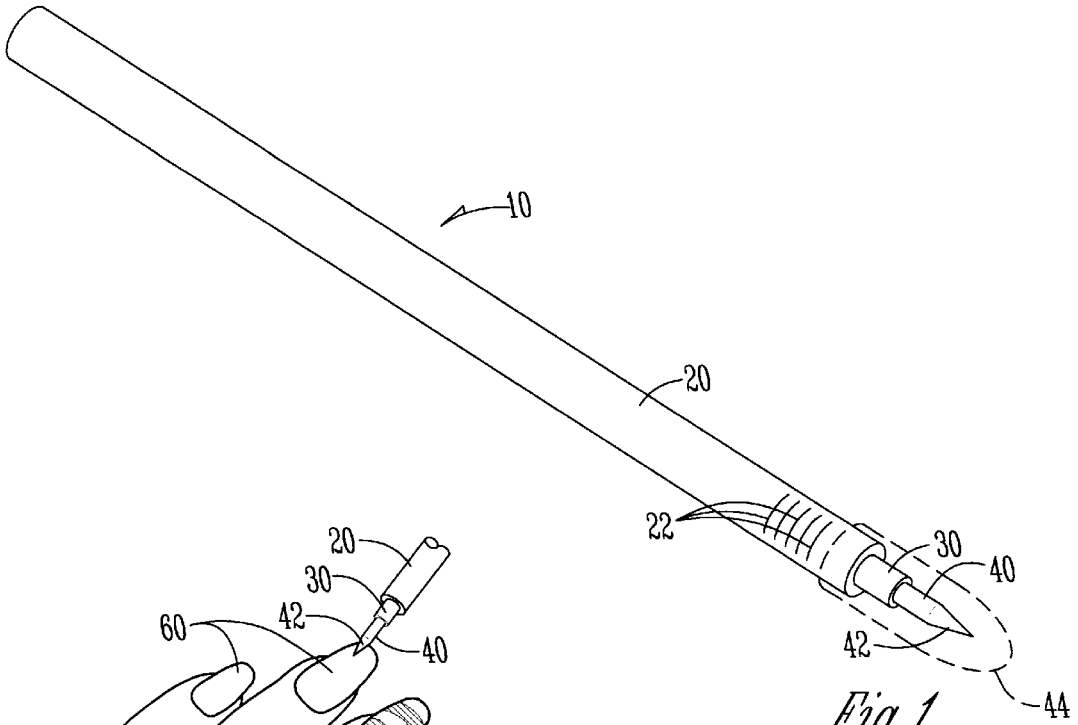
FIG. 1 is a perspective view of an air brush paint marker in accordance with the present invention.

The nail painting marker of the present invention is generally designated by the numeral 10 as shown in FIG. 1. The marker 10 includes a tube 30 housed within a casing 20. The casing 20 forms a protective outer layer for the tube 30. The casing 20 can be textured or provided with ribs 22 to make the marker 10 easier to grip and handle, and may be colored or decorated. The casing 20 is preferably of a size slightly larger than the tube 30.

The tube 30 stores the air brush paint within the marker 10. The tube 30 should be of a sufficient length and width to make it easy to handle and to prevent the need for frequent refilling of the paint. It should also be small enough to make it convenient to carry. A preferred size is that of a conventional felt tip marker or ball point pen.

Extending from the tube 30 is an absorbent applicator 40. The applicator 40 must extend at least slightly beyond the casing 20 and tube 30. The applicator 40 should be sufficiently absorbent to hold the paint and keep it from dripping. An example of a preferred applicator 10 is the type conventionally found in felt tip markers or in cake decorating pens.

Figure 2:
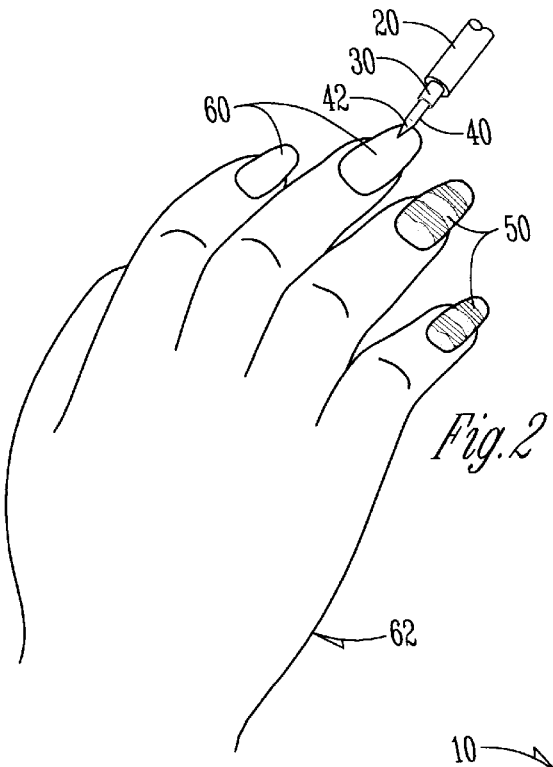
FIG. 2 is an elevational view of the air brush paint marker as shown being used to apply air brush paint to an individual's fingernails.
Figure 3:
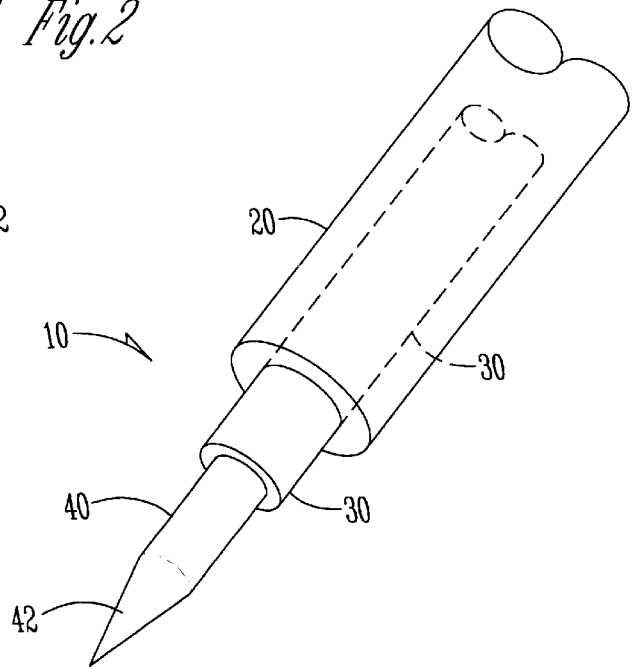
FIG. 3 is an enlarged perspective view of the tip of the air brush paint marker.

The applicator 40 has a tip 42 which is preferably pointed as shown in FIGS. 1–3 to allow for precise application of the air brush paint. A pointed tip 42 also enables the individual to stencil designs on the nail and to create fine or small details. The tip 42 can also be shaped in various patterns or shapes for making intricate nail designs. FIG. 2 illustrates the air brush paint 50 being applied from marker 10 to the fingernails 60 of a hand 62.

The applicator 40 is covered with a removable cap (not shown) for storage purposes when marker 10 is not being used to keep the applicator 40 from contacting or staining other surfaces and to prevent the paint from drying out.

The nail painting marker 10 can be premanufactured with the air brush paint already included. The markers can be packaged in groups of several different colors.

Based on the ease and low cost of making the nail painting marker 10, individuals can purchase several different markers of different colors. The process is so simple that kids can easily use their own nail painting markers 10, and, because of their precise application, can paint and create their own intricate nail designs.

The present invention thus offers the user the benefit of being able to easily and inexpensively create unique nail designs frequently without the expense of a professional manicure. While the air brush paint bonds well to the nail and does not smear or rub off once it is dry, it can also be easily removed using nail polish remover.

It can therefore be seen that the present invention accomplishes at least all of its stated objectives.

What is claimed is:

1. A method of painting finger or toe nails, comprising:

contacting a nail with the tip of a first marker containing a first color of non-toxic, water-based, permanent, acrylic air brush paint, said paint being contained in an absorbent applicator that is sufficiently absorbent such as to hold the paint and keep the paint from dripping;

whereby the paint is drawn through the applicator through wicking action and such that the contact pressure causes the paint to be applied to the nail.

2. A method of claim 1 further comprising:

contacting the same nail with a tip of a second marker containing a second color of non-toxic, water-based, permanent, acrylic air brush paint, such that the contact pressure causes paint to be applied to the nail, thereby providing a multi-colored nail.

3. The method of claim 1 wherein the application of paint to the nail is free from the use of an air spray.

4. The method of claim 1 wherein the paint is applied to the nail only where the tip of the marker contacts the nail.

5. The method of claim 1 further comprising:

using multiple markers with multiple colors of paints to sequentially contact the nail to sequentially apply different colors of paint to the nail in a desired pattern.

6. A method according to claim 1 wherein the tip of the first marker is pointed to allow the user to create fine or small details with the paint on the nail.

7. A method according to claim 1 wherein the tip of the first marker is shaped to allow the user to create intricate designs with the paint on the nail.

8. A method of painting finger or toe nails, consisting essentially of:

physically engaging a paint applicator containing non-toxic, water-based, permanent, acrylic air brush paint to the nails to transfer paint from the applicator to the nail without having to reload the applicator with additional paint to paint additional nails;

whereby the paint is drawn through the applicator through wicking action and such that the engagement pressure causes the paint to be applied to the nail.

9. The method of claim 8 wherein the applicator continuously supplies paint to the nails upon contact with the nails.

10. A method of painting finger or toe nails, comprising:

drawing acrylic air brush paint through a wick housed in a casing, the wick being sufficiently absorbent such as to hold the paint and keep the paint from dripping, the wick having a pointed tip;

contacting a nail with the tip of the wick to apply the paint to the nail.

* * * * *